United States Patent [19]

Hagemann et al.

[11] 4,313,282

[45] Feb. 2, 1982

[54] WINDOW CRANK ASSEMBLY

[75] Inventors: Edmund Hagemann, Wolfsburg; Herbert Wildschütte, Brunswick, both of Fed. Rep. of Germany

[73] Assignee: Volkswagenwerk AG, Wolfsburg, Fed. Rep. of Germany

[21] Appl. No.: 93,928

[22] Filed: Nov. 13, 1979

[30] Foreign Application Priority Data

Nov. 15, 1978 [DE] Fed. Rep. of Germany ..... 2849445

[51] Int. Cl.[3] ..... E05F 11/48

[52] U.S. Cl. ..... 49/352

[58] Field of Search ..... 49/352; 403/370, 374, 403/371

[56] References Cited

U.S. PATENT DOCUMENTS

| | | | |
|---|---|---|---|
| 757,154 | 4/1904 | Tate | 49/371 X |
| 3,890,743 | 6/1975 | Eckhardt et al. | 49/352 |
| 4,109,417 | 8/1978 | Fogarollo | 49/352 |
| 4,199,899 | 4/1980 | Muhling et al. | 49/352 |

FOREIGN PATENT DOCUMENTS

| | | | |
|---|---|---|---|
| 2803807 | 2/1979 | Fed. Rep. of Germany | 49/352 |

*Primary Examiner*—Philip C. Kannan

*Attorney, Agent, or Firm*—Spencer & Kaye

[57] ABSTRACT

A window crank assembly includes a stationarily supported cable drum having a core; a housing accommodating the cable drum and having a slot; a cable slung about the core and passing through the slot and being connected to the window pane; a drive for rotating the core, whereby a pulling force is exerted on the cable; a cable conduit accommodating a length portion of the cable as well as fittings supporting opposite ends of the cable conduit. At least one of the fittings is supported on a guide segment member in the vicinity of the cable drum at a predetermined distance from the core. This fitting is swingably arranged on the guide segment member for motion in a plane which is parallel to the slot provided in the housing.

11 Claims, 6 Drawing Figures

WINDOW CRANK ASSEMBLY

BACKGROUND OF THE INVENTION

This invention relates to a window crank assembly which includes a stationarily supported cable drum for transmitting pulling forces to a cable which is wound about a core rotatable by a drive. The cable passes through an opening in a stationary housing of the cable drum and is, externally of the housing, connected with a substantially vertically displaceably guided window pane. Along a length portion the cable extends in a cable conduit, the opposite ends of which are supported in fittings. At least one of the fittings is situated in the vicinity of the cable drum at a predetermined distance from the core.

A window crank assembly of the above-outlined type which finds advantageous application particularly in the side doors of automotive vehicles for raising and lowering the door windows, is disclosed, for example, in U.S. Pat. No. 3,890,743. By virtue of the use of a flexible bowden cable—namely a cable positioned within a flexible cable conduit which is supported at its ends—the known window crank assembly has the advantage that it can be prefabricated as a unit and can be installed in vehicle doors of different dimensions and configurations. In this known arrangement the ends of the cable conduit are held firmly by fittings which are fixedly mounted on a base plate. The latter also serves to carry the cable drum.

SUMMARY OF THE INVENTION

It is an object of the invention to provide an improved window crank assembly of the above-outlined type whose installation in different mounting environments determined by the different dimensions and configurations of vehicle doors is further facilitated.

This object and others to become apparent as the specification progresses, are accomplished by the invention, according to which, briefly stated, one of the fittings for the cable conduit is pivotally mounted in such a manner that it can execute swinging motions about the cable drum. Further, the pivotal fitting is supported at a guide segment against the pressure force exerted by the cable conduit. Further, the opening in the housing through which the cable passes is a slot whose length dimension extends parallel to the direction of pivotal motion of the pivotally supported fitting.

Thus, an essential feature of the invention resides in arranging at least one of the two fittings in the vicinity of the cable drum not in a fixedly secured manner, but so that it can pivot about the cable drum and it can engage a guide segment, whereby there is achieved, during installation of the window crank assembly, an automatic alignnment of the cable and the pivotal fitting. According to a feature of the invention, the opening in the cable drum housing through which the cable passes has an elongated, slot-shaped configuration which extends parallel to the direction of pivotal motion of the fitting to thus provide a free path of lateral displacement for the cable upon pivotal motion of the fitting.

The other fitting for the cable conduit can also be arranged on the cable drum, particularly if the cable forms a closed loop. Or, according to a further feature of the invention, the other fitting is mounted on a stationary guide rail, and has a clamp surrounding the cable conduit at its end. The clamp has bent-back lateral legs and is arranged within the guide rail (which has a U-shaped cross section) and engages with claws into openings of the lateral walls of the guide rail.

The structure according to the invention, as described above, takes into consideration the circumstance that different conditions for mounting may be present within the plane of the door, dependent upon the particular door construction. The invention, however, also provides for the use of the window crank assembly in doors of different thicknesses resulting from tolerances or different structural designs. Thus, according to a further feature of the invention, the drive of the cable drum has a shaft assembly which extends into a support provided in the core. The shaft assembly has an external hollow shaft whose end portion positioned within the support is longitudinally slotted, a clamping cone positioned within the longitudinally slotted end of the hollow shaft and a setscrew which extends inside the hollow shaft coaxially therewith and which serves for drawing the clamping cone tightly against the shaft end. The non-rotatable connection between the shaft and the support is thus made by spreading apart the slotted end of the hollow shaft by the clamping cone. Thus, for determining the position of the shaft assembly in the support in the axial and circumferential directions, it is sufficient that the longitudinally slotted end portion of the hollow shaft be situated at some place within the support.

DESCRIPTION OF THE PREFERRED EMBODIMENT

Figure 1:
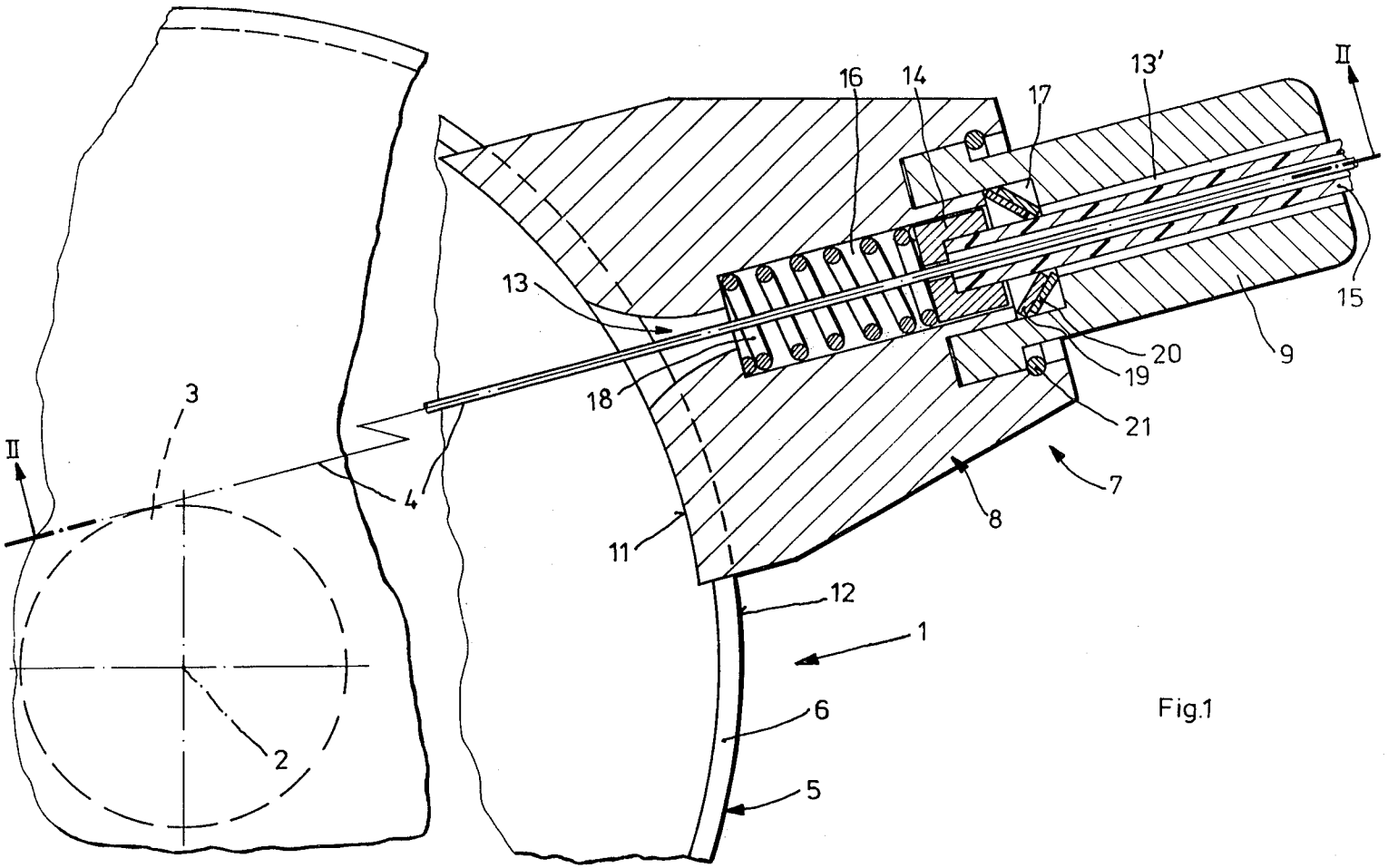
FIG. 1 is a sectional view of a part of a preferred embodiment of the invention taken along line I—I of FIG. 2.
Figure 2:
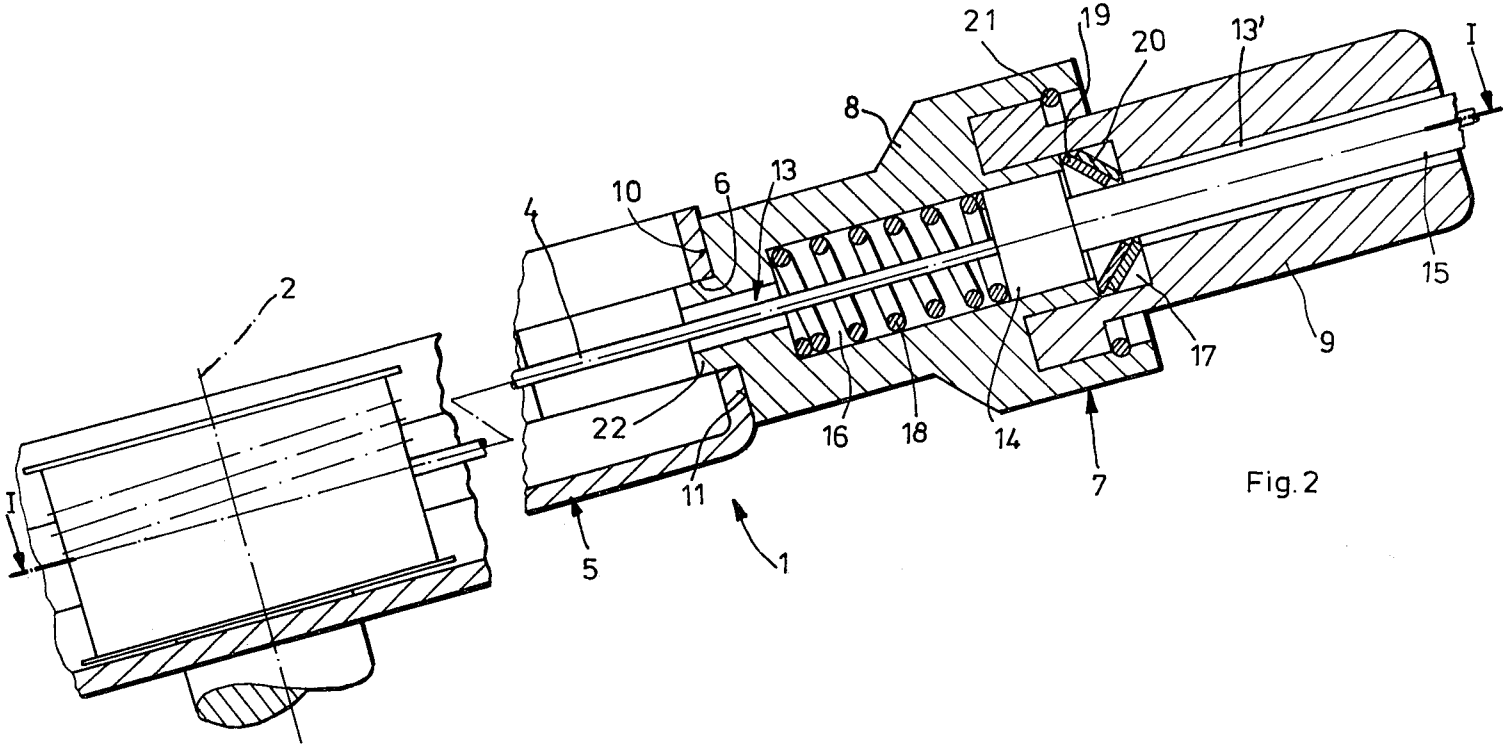
FIG. 2 is a sectional view taken along line II—II of FIG. 1.

Turning first to FIGS. 1 and 2, there is shown a cable drum assembly generally indicated at 1, essentially comprising a core 3 which is rotatable about an axis 2 by means of a crank or a drive motor and about which a cable 4 is slung. The cable drum assembly 1 further comprises a housing 5 provided with a circumferentially extending slot 6 through which the cable 4 passes. The cable drum assembly further may include springs within the core 3 as well as other conventional structural details which are well known and which, since they do not form part of or do not directly cooperate with the invention, are not illustrated or described. The housing 5 is fixedly mounted, for example, on a plate member which is installed in a vehicle door.

Figure 6:
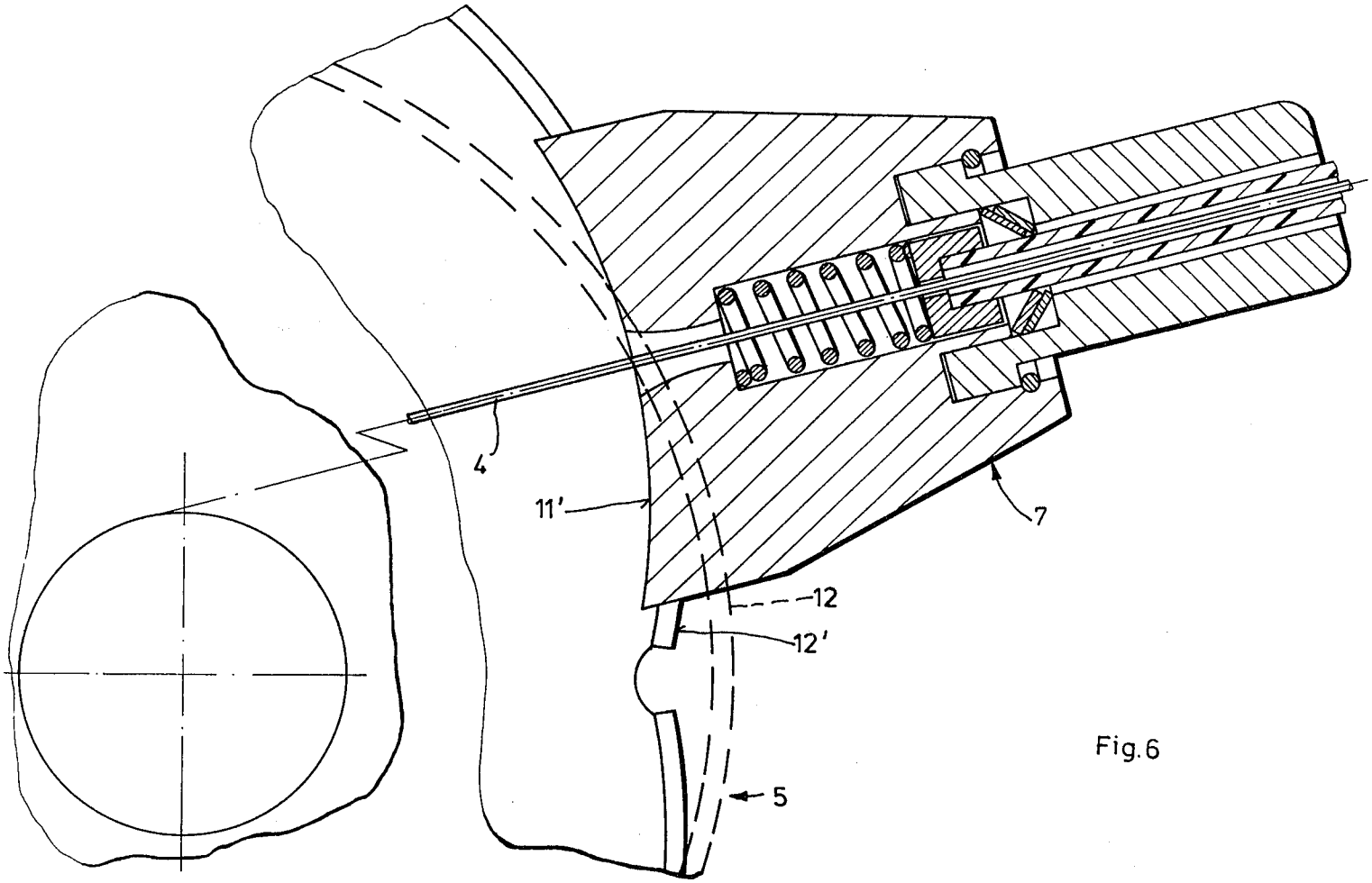
FIG. 6 illustrates a variant of the structure shown in FIG. 1.

The housing 5 simultaneously serves as a guide segment for a fitting 7 which essentially comprises a glide shoe 8 and a cover sleeve 9. The glide shoe 8 has two slide faces 10 and 11 with which the glide shoe 8 is supported on a guide track 12 of the guide segment of the housing 5. The slide faces 10 and 11 assume the arcuate shape of the guide track 12. In the illustrated embodiment the guide track 12 has a circularly arcuate shape and is concentric with the axis 2 of the core 3 of the cable drum 1. It is feasible, however, to design this arrangement differently; the shape of the guide track 12 can be other than circularly arcuate. For example, its course may be adapted to the unwinding curve of the cable from the core of the cable drum. Such a guide track is shown at 12' in FIG. 6 in comparison with circular guide track 12. Of course, slide faces 10 and 11 must be adapted to the shape of guide track 12', as shown at 11'.

The glide shoe 8 and the cover sleeve 9 have aligned throughgoing linear passages 13 and 13', respectively, which are so oriented that the cable 4 guided therein extends substantially tangentially to the core 3 of the cable drum. The linear passage 13 has an enlargement which constitutes a chamber 16, whereas the linear passage 13' has an enlargement which constitutes a chamber 17. In the chamber 16 there is positioned a thimble 4 which receives and supports an end of the cable conduit 15 and which is biased by a compression spring 18 (also disposed in the chamber 16) against pressure forces exerted by the cable conduit 15. The chamber 17 serves for receiving two superposed clamping washers 19 and 20 which are so arranged that they prevent displacements of the cable conduit 15 in the direction of the cable drum 1, that is, in a direction towards the left as viewed in FIGS. 1 and 2, whereas they permit a displacement of the cable conduit 15 in the opposite direction.

The glide shoe 8 and the cover sleeve 9 are coupled to one another by means of a snap ring 21.

If, while installing the window crank assembly in the vehicle door, forces are generated in the circumferential direction of the cable drum 1, a displacement of the fitting 7 occurs automatically in the circumferential direction of the cable drum. During this occurrence, the fitting 7 is guided by its foot portion 22 projecting into the slot 6 provided in the cable drum housing 5. For adapting the window crank assembly to different door constructions and different mounting requirements it is thus not necessary—as it has been the case heretofore—to secure the fitting or fittings for the cable conduit to any door component or other part (in which case the different tolerances still have not been taken into consideration); rather, such a setting and adaptation occurs quasi-automatically.

Figure 4:
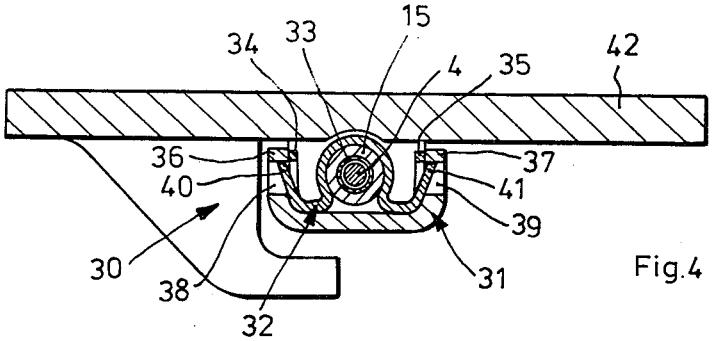
FIG. 4 is a sectional view taken along line IV—IV of FIG. 3.
Figure 3:
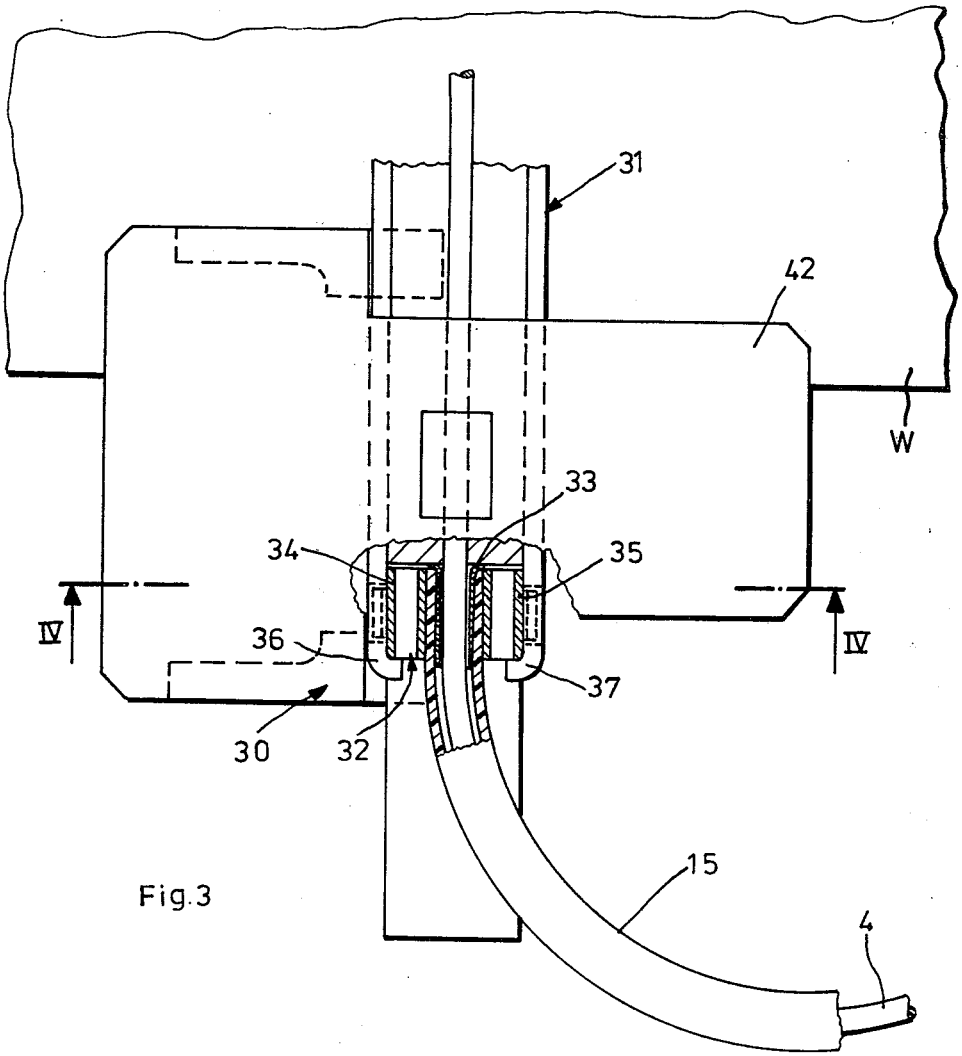
FIG. 3 is a partially sectional view of another part of the preferred embodiment.

Turning now to FIGS. 3 and 4, a second fitting 30 is provided for the other end of the flexible cable conduit 15. This end is situated on a guide rail 31. The fitting 30 is, in essence, formed of a resilient clamp 32 which, at its mid zone, surrounds and firmly grips the end portion of the cable conduit 15 with the aid of a nozzle-shaped member 33 extending inside the cable conduit 15 and surrounding the cable 4. The clamp 32 has lateral, bent-back legs 34, 35 with which it engages the inside of lateral walls 36 and 37 of the guide rail 31. The latter has an approximately U-shaped cross section. The walls 36 and 37 are provided with respective openings 38 and 39 into which lock claws 40 and 41 of the legs 34 and 35 of the resilient clamp 32.

Thus, while the cable conduit 15 is fixedly held by means of the fitting 30, the cable 4 is secured to a carriage 42 in a conventional manner. The carriage 42 is displaceable on and along the rail 31 and is connected with the window pane W.

The features of the invention described heretofore thus serve for the adaptation of the window crank assembly to different mounting environments in the zone of the plane of the door.

Figure 5:
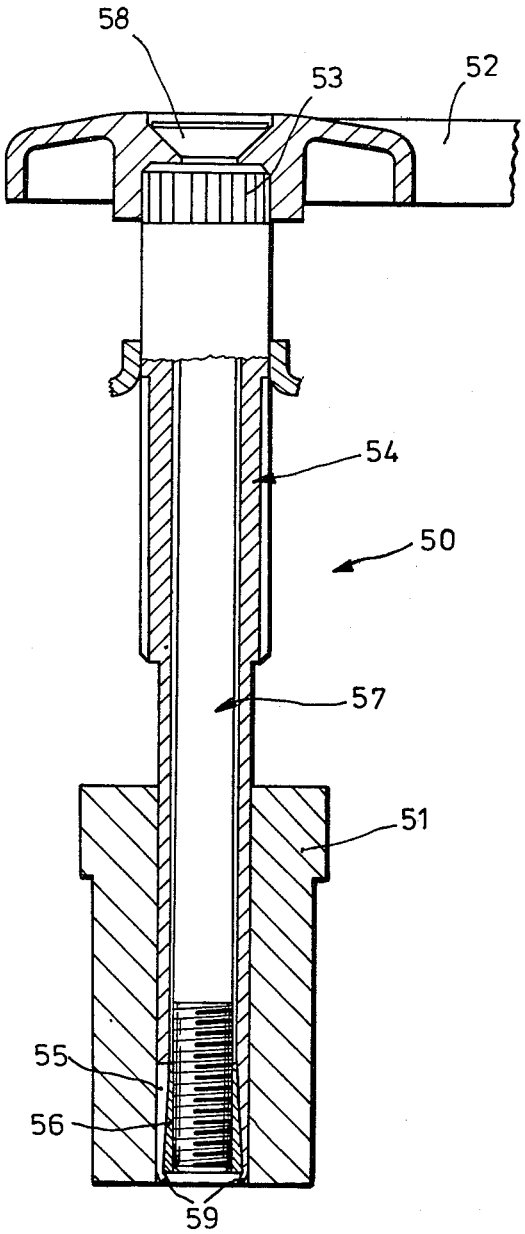
FIG. 5 is a longitudinal sectional view of a further part of the preferred embodiment.

Turning now to FIG. 5, for an adaptation to doors of different thicknesses, the drive shaft assembly 50 for the core 3 of the cable drum is of length-adjustable structure. The drive shaft assembly 50 is to be affixed non-rotatably (that is, for torque transmission) to a support 51 which, in turn, extends into the core 3 of the cable drum and is non-rotatably secured thereto. The drive shaft assembly 50 comprises a hollow shaft 54, one end of which extends within the support 51, while its other end carries a manually operable crank lever 52 attached to the shaft end for torque transmission. For this purpose the crank lever 52 is press-fitted on the hollow shaft 54 about the knurled terminal portion 53. That end portion of the hollow shaft 54 which is situated inside the support 51 is provided with longitudinal slots 55. In view of the gradual decrease in the wall thickness in the direction of the last-named end of the hollow shaft 54, it is therefore possible to spread out this slotted terminal zone by means of a clamping zone 56 for providing a fixed securement of the shaft 54 to the inner face of the support 51. For this purpose the clamping cone 56 is pulled upwardly as viewed in FIG. 5. Such an upward displacement is effected by means of setscrew 57 which extends within the hollow shaft 54 and which has a head 58 in the hub zone of the crank lever 52. In order to prevent the clamping cone 56 from dropping out, that end of the hollow shaft 54 which is situated inside the support 51 may be crimped inwardly as indicated at 59. It is to be understood that instead of the manual crank lever 52 the hollow shaft 54 can be motor-driven.

The invention thus provides a window crank assembly which, without any modification, may find wide application in mounting environments which may significantly differ from one another due to large tolerances or different structural designs.

It will be understood that the above description of the present invention is susceptible to various modification, changes and adaptations, and the same are intended to be comprehended within the meaning and range of equivalents of the appended claims.

What is claimed is:

1. In a window crank assembly for raising and lowering a window pane, including a stationarily supported cable drum having a core; a housing accommodating the cable drum and having an opening; a cable slung about the core and passing through the opening and being connected to the window pane; drive means for rotating the core for exerting a pulling force on the cable; a cable conduit accommodating a length portion of the cable and having opposite ends; first and second fittings supporting opposite ends of the cable conduit; at least the first fitting being arranged in the vicinity of the cable drum at a predetermined distance from the core; the improvement comprising a guide segment member supporting said first fitting against pressing forces exerted thereon by said cable conduit; said first fitting being swingably arranged on said guide segment member for motion in a predetermined plane; said opening in said housing comprising a slot extending parallel to said plane, whereby freedom of lateral motion of said cable is provided for following any swinging motion of said first fitting.

2. A window crank assembly as defined in claim 1, wherein said guide segment member is constituted by a portion of said housing.

3. A window crank assembly as defined in claim 1, wherein said guide segment member comprises a guide track on which said first fitting is displaceably supported.

4. A window crank assembly as defined in claim 3, wherein said core has a rotary axis and further wherein said guide track has a circularly arcuate course having a center lying on said rotary axis.

5. A window crank assembly as defined in claim 3, wherein said core has a rotary axis and further wherein said guide track has an arcuate course deviating from an imaginary circle having a center lying on said rotary axis for taking into account the unwinding curve of said cable.

6. A window crank assembly as defined in claim 1, wherein said guide segment member comprises a guide track substantially codirectional with said slot; and further wherein said first fitting comprises (a) a glide shoe having
  (1) at least one slide face being in gliding engagement with said guide track;
  (2) means defining a first throughgoing passage oriented substantially tangentially to said core and aligned with said slot; said cable passing through said first throughgoing passage;
(b) a cover sleeve secured to said glide shoe and having means defining a second throughgoing passage aligned with said first throughgoing passage; said cable passing through said second throughgoing passage;
(c) means defining a first chamber in said first fittting; said cable passing through said first chamber;
(d) a thimble disposed in said first chamber; said thimble receiving an end of said cable conduit;
(e) a compression spring disposed in said first chamber for biasing said thimble against pressing forces exerted by said cable conduit;
(f) means defining a second chamber in said first fitting; said cable passing through said second chamber; and
(g) motion limiting means disposed in said second chamber for preventing said cable conduit from shifting solely in a direction against the force exerted by said compression spring.

7. A window crank assembly as defined in claim 6, wherein said motion limiting means comprises at least one clamping washer circumferentially engaging said cable conduit.

8. A window crank assembly as defined in claim 6, wherein said glide shoe projects into said slot.

9. A window crank assembly as defined in claim 1, further comprising a stationarily supported rail oriented parallel to the motion of the window pane; said rail having side walls and a generally U-shaped cross section; a carriage mounted on said rail for travel thereon; said cable being secured to said carriage and said carriage being secured to the window pane; said second fitting comprising a clamp surrounding and firmly holding an end of said cable conduit; said clamp being situated on said rail between said side walls and having oppositely oriented, lateral bent-back legs supported by inner surfaces of said side walls; and securing means for fixedly holding said clamp on said rail.

10. A window crank assembly as defined in claim 9, wherein said securing means comprises claws forming portions of said bent-back legs and means defining apertures in said side walls; said claws enaging into said apertures.

11. A window crank assembly as defined in claim 1, wherein said drive means comprises a drive shaft assembly and a support member affixed to said core and having a bore hole, said drive shaft assembly including (a) a hollow shaft having a longitudinally slotted terminal portion situated in said bore hole;
(b) a clamping cone situated inside said hollow shaft in the zone of the longitudinally slotted terminal portion thereof; and
(c) a setscrew threadedly engaging said clamping cone and extending within said hollow shaft for drawing said clamping cone into said hollow shaft to spread apart the slotted terminal portion thereof whereby said hollow shaft is clamped to said support member.

* * * * *